United States Patent [19]

Coulter

[11] Patent Number: 4,505,410

[45] Date of Patent: Mar. 19, 1985

[54] FLUID APPLICATOR FOR TREATING GARMENTS

[76] Inventor: John P. Coulter, 10 Hilton Dr., Shipley, West Yorkshire, England

[21] Appl. No.: 378,072

[22] Filed: May 14, 1982

[30] Foreign Application Priority Data

May 16, 1981 [GB] United Kingdom ..... 8115075

[51] Int. Cl.[3] ..... B05C 13/02

[52] U.S. Cl. ..... 222/611; 222/614; 222/620; 222/327; 222/390; 118/708; 401/48; 401/193

[58] Field of Search ..... 222/173, 611, 613, 614, 222/620, 325, 326, 327, 386, 390, 391; 401/48, 172, 193; 118/708, 710, 711

[56] References Cited

U.S. PATENT DOCUMENTS

| | | | |
|---|---|---|---|
| 401,771 | 4/1889 | Bain | 118/710 |
| 1,661,599 | 3/1928 | Cynova | 401/193 X |
| 4,182,264 | 1/1980 | Gibson et al. | 401/48 |

*Primary Examiner*—Joseph J. Rolla

*Assistant Examiner*—Lawrence J. Miller

*Attorney, Agent, or Firm*—Bert J. Lewen

[57] ABSTRACT

A fluid dispensing applicator for crease setting compositions comprises a support 16, a reservoir 12 slidably mounted on the support 16, an applicator nozzle 14 connected to the reservoir 12 to deliver fluid therefrom, and a bearing element 40 movable relative to the support 16 between retracted and advanced positions capable of effecting slidable movement of the reservoir respectively towards and away from the support 16 when so moved. A rotatable member 18 is mounted on the support and is geared to a piston arrangement 32, 34 for urging fluid from the reservoir 12 through the nozzle 14. The nozzle 14, bearing element 40 and the periphery of the rotatable member 18 are aligned on the same side of the applicator. When the applicator is not in use a combination of the pressure within the reservoir 12 and gravity cause the bearing element to move the reservoir into the retracted position thereby relieving the pressure in the reservoir and preventing oozing of crease setting composition from the nozzle 14.

7 Claims, 2 Drawing Figures

FLUID APPLICATOR FOR TREATING GARMENTS

Figure 1:
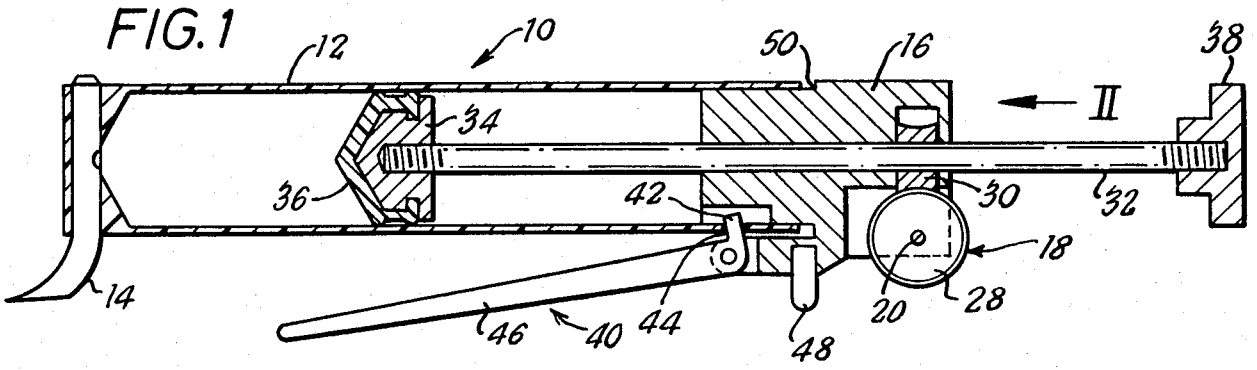

This invention relates to a fluid dispensing applicator for crease setting compositions.

In our U.S. Pat. No. 4,182,264 there is disclosed a fluid dispensing apparatus for applying a crease setting composition to garments which comprises a reservoir, a nozzle connected therewith, a rotatable member engageable with the garment surface and means responsive to rotation of the member for urging fluid from the reservoir through the nozzle. In order to prevent crease setting composition from oozing from the nozzle in between successive operations, the apparatus is provided with a spring-loaded lever system connected to the means for urging the fluid from the reservoir through the nozzle so that, when manual pressure is released from the lever, the reservoir is depressurised thereby preventing unwanted oozing of fluid from the nozzle.

In the applicator disclosed in U.S. Pat. No. 4,182,264 the lever is disposed above the apparatus directly over the rotatable member engageable with the garment surface. It has been found that, especially for operatives with small hands, this form of mechanism is difficult to use since when manual pressure is applied to the lever above the rotatable members it is difficult at the same time accurately to guide the dispensing nozzle.

The invention seeks to provide a simplified form of mechanism for use with the above mentioned applicator which overcomes or reduces the disadvantages of the former mechanism.

According to the present invention there is provided a fluid dispensing applicator for crease setting compositions which comprise a fluid reservoir, an applicator nozzle connected to the reservoir to deliver fluid therefrom, a member rotatably mounted on or adjacent the reservoir, means responsive to rotation of the member for urging fluid from the reservoir through the nozzle in proportion to the degree of rotation of the rotatable member, and means responsive to the positioning of the apparatus at its work station to pressurise the fluid in the reservoir and depressurise the fluid when the apparatus is removed from the work station.

In one preferred embodiment the applicator comprises a support, a reservoir slidably mounted on the support, an applicator nozzle connected to the reservoir to deliver fluid therefrom, a bearing element movable relative to the support between retracted and advanced positions and capable of effecting sliding movement of the reservoir respectively towards and away from the support when so moved, a member rotatably mounted on the support and means responsive to rotation of the member for urging fluid from the reservoir through the nozzle.

Preferably the nozzle, bearing element and periphery of the rotatable member are aligned on the same side of the applicator.

Preferably the bearing element comprises a lever arrangement pivotally mounted on the support having a lever arm which, in use, depends below the applicator body into the crease line of the garment being treated.

On removing the applicator from the garment being treated, the pressure of setting composition within the reservoir together with the action of gravity on the lever arm depending below the body of the applicator combine to urge the reservoir away from the support thereby relieving pressure within the reservoir and prevent oozing of excess setting composition through the nozzle. With the apparatus according to the invention no separate spring means are required since the combination of pressure within the reservoir and gravitational action ensure that the residual pressure within the reservoir is relieved as soon as the applicator is removed from a garment being treated, automatically, without conscious effort by the operator. Conversely, on positioning the applicator at its work station, e.g. in contact with a garment, the reservoir is re-pressurised for immediate use. The design of the applicator is also simplified, making the applicator cheaper to manufacture. Furthermore, the preferred lever arm, which in use locates within the crease line of the garment being treated, provides additional guiding means and helps ensure accurate application of the crease setting composition within the crease of the garment being treated. Since the preferred lever arm is now located below the applicator body the operative can hold the applicator at any part he wishes and is not limited to holding the applicator at one location as with the previous device.

Figure 2:
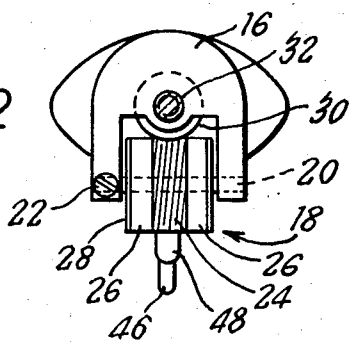

The invention will be described further, by way of example, with reference to the accompanying drawings, in which:

FIG. 1 is a longitudinal section view of a dispensing apparatus according to the invention; and FIG. 2 is an end view of the apparatus taken in the direction of arrow 2 in FIG. 1.

Referring to the drawings, a dispensing applicator 10 comprises a reservoir 12 in the form of a moulded plastic cartridge body having a nozzle 14 which, in use, depends into the crease line of the garment being treated. The cartridge 12 contains a crease setting composition, for example a curable silicone rubber compound, and is a slidable fit onto a shaped support block 16. The block 16 may be made from metal or may preferably be a plastics material moulding. A rotatable member 18 is mounted on an axle 20 held within the block 16 by means of a grub screw 22. The member 18 comprises a central threaded portion forming a worm drive 24 flanked by rubber surfaces 26 which, in use, contact the garment on either side of the crease line. Flange portions 28 complete the construction of the rotatable member 18.

The worm drive 24 of the rotatable member 18 contacts a gear wheel 30 held captive within the block 16 and in threaded engagement with a threaded rod 32. Thus rotation of the member 18 rotates the gear wheel 30 and thereby drives the rod 32. The rod 32 carries at one end thereof a plunger portion 34 which, in use, inter-engages with a plastics material piston portion 36 located within the cartirdge body 12 in fluid sealing contact with internal walls thereof. The other end of the rod 32 is provided with a knurled knob 38 for manual rotation of the rod 32 when required as explained more fully hereinafter.

Pivotally attached to a lower portion of the block 16 is a bearing element which comprises a lever arrangement 40 having a spigot portion 42 located in an orifice 44 within the cartridge body 12, and an elongate lever arm portion 46. In another form of the applicator, the lever arm portion 46 may be considerably shorter in length but be made deeper, so that its upper side contacts the under side of the reservoir 12 providing a movement limiting stop. A guide member 48 is also located projecting from the bottom of the body member 16.

It will be appreciated that the cartridge 12 is disposable so that in use of the applicator a fresh cartridge 12 having its own piston member 36 is slid onto the block 16 and located in position by rotating the lever arrangement 40 and inserting the spigot 42 of the lever assembly 40 into the hole 44 in the cartridge 12. The knurled knob 38 on the rod 32 is turned, screwing the plunger portion 34 to the left as viewed in FIG. 1, until it is received into and engages with the piston portion 36 thereby applying pressure to the crease setting composition within the cartridge 12 causing it to sweep the contents of the cartridge 12 towards the nozzle 14. The apparatus is now ready to be used. In applying crease setting compositions to garments e.g. trousers, the garment is turned insideout, and placed in a suitable former, for example a former such as that described in our U.S. Pat. No. 4,182,264. The apparatus of the invention is then moved to its work station, i.e. placed on the garment with the nozzle 14, the lever arm 46, and the guide projection 48 all within the crease line and the surface 26 of the rotatable member 18 in contact with the garment fabric on either side of the crease line. Drawing the applicator along the crease line in the direction opposite to arrow II of FIG. 1 rotates the member 18 thereby urging the rod 32 and hence the piston 36 to the left as viewed in FIG. 1 thus expelling crease setting composition through the nozzle 14 at a rate proportional to the rate of motion of the applicator, thereby ensuring an even length-distribution of crease setting composition. When the applicator is at its work station in place over a garment crease line the lever arm 46 is urged upwards towards the main body of the applicator thus pivoting the spigot 42 to the right as viewed in FIG. 1 and urging the cartridge 12 hard against the shoulder 50 on the body 16. On lifting the applicator from its work station and the garment, a combination of the residual pressure within the cartridge reservoir 12 and the action of gravity on the lever arm 46 turning the lever arrangement anti-clockwise as viewed in FIG. 1 moves the cartridge 12 to the left as viewed in FIG. 1 thereby relieving the pressure within the reservoir portion and preventing the setting composition from oozing from the nozzle 14 after the applicator has been removed from the garment. Replacing the applicator on the crease line turns the lever arrangement clockwise once again thereby repressurising the cartridge 12.

The apparatus so described performs a similar function to that described in our U.S. Pat. No. 4,182,264 but, does it automatically without a separate manual operation and, containing less moving parts, is considerably cheaper to manufacture. Furthermore it is smaller and easier to handle. Also having no lever on the upper side of the device the operative can hold the device at any point desired which facilitates guiding the nozzle accurately within the crease line. The spigot 42 within the hole 44 in the cartridge 12 may also provide the sole means by which the cartridge 12 is held on the body portion 16, again simplifying manufacture and operation. This has the further advantage that the bearing surface, namely the edges of the hole 44 in the cartridge 12, is renewed every time the cartridge is renewed thereby extending the useful life of the applicator.

Except where otherwise indicated above, the mode of operation of the device of the present invention, as well as its uses, is identical to that of the applicator described in our before mentioned U.S. Pat. No. 4,182,264. Moreover, the applicator of the present invention is found particularly useful in difficult applications, for example with lined trousers where the weight of the garment tends to obscure the crease line.

In the practice of this invention, it has been found that permanent creases of superior quality and appearance may be obtained with the gear ratio between the rotatable member 18 and the piston 36 selected to be such that a peripheral movement of 1 cm of the rotatable member causes the piston to displace a volume of 1 to 10 $\mu$l in the reservoir. With such a gear ratio the application of adequate yet controlled and effectively distributed quantities of the creasing composition is ensured, giving a process of hitherto unattained commercial value.

Furthermore, it is preferred that the gearing should be such that the piston is advanced through the reservoir towards the nozzle when the applicator is drawn along the line of the crease with the nozzle at the rear, instead of being pushed along with the nozzle leading. The gear ratio between the worm 24 and the gear wheel 30 is preferably 1 to 40. The pitch of the thread on the rod 32 in one example is such that the piston displaces about 1.5 $\mu$l per cm peripheral movement of the roller 18. For use on a heavier fabric, this displacement may be increased to about 2.5 $\mu$l/cm.

The pressurising and de-pressurising concept of the invention has been described with relation to hand applicators such as that disclosed in our above mentioned Patents. However, it is not limited thereto and may be used in any kind of applicator, manual or powered, where dispensing of pressurised viscous compositions takes place and/or where oozing of composition is a problem.

I claim:

1. A fluid dispensing applicator for applying a crease setting composition to a garment comprising: an elongated fluid reservoir; an applicator nozzle connected to the reservoir to deliver fluid therefrom; a support; means for mounting the reservoir on the support to permit sliding movement between the support and the reservoir in a direction parallel to the longitudinal axis of the reservoir; a member rotatably mounted on the support; means responsive to rotation of the member for urging fluid from the reservoir through the nozzle in proportion to the degree of rotation of the rotatable member; a bearing element mounted on the support capable of movement between a retracted and an advanced position relative to the support; the nozzle, the bearing element and the periphery of the rotatable member being mounted on the same side of the applicator and aligned longitudinally therewith, so that each can be placed in simultaneous contact with the garment; coupling means for coupling the bearing elements to the reservoir so that, when the bearing element is forced against the garment, the bearing element is moved from its advanced to its retracted position whereby the reservoir slides towards the support and the fluid in the reservoir is pressurized; and, when the bearing element is not forced against the garment, the bearing element moves from its retracted to its advanced position whereby the reservoir slides away from the support and the fluid in the reservoir is depressurized.

2. An apparatus as claimed in claim 1 in which the reservoir comprises a disposable cartridge.

3. An applicator as claimed in claim 2 in which the cartridge contains a silicone based crease setting composition.

4. An applicator as claimed in claim 1 in which the bearing element comprises a lever arrangement pivotally mounted on the support having a lever arm which, in use, depends below the applicator body into the crease line of a garment being treated.

5. An applicator as claimed in claim 4 in which the lever arrangement has a spigot portion located in an orifice within the reservoir.

6. The fluid applicator of claim 1 further comprising guidance means mounted beneath the reservoir adapted, in use, to depend into the crease line of a garment being treated and to serve as a visual guide to facilitate the alignment of the applicator nozzle with the crease line.

7. An applicator as claimed in claim 6 in which the guidance means comprises a projection which may be aligned with the crease line.

* * * * *